US011845161B2

(12) United States Patent
Bestwick et al.

(10) Patent No.: US 11,845,161 B2
(45) Date of Patent: Dec. 19, 2023

(54) METHODS OF INSTALLING FASTENERS AND APPARATUS RELATING THERETO

(71) Applicant: AIRBUS OPERATIONS LIMITED, Bristol (GB)

(72) Inventors: Richard Bestwick, Bristol (GB); Guillaume Le Mevel, Bristol (GB); Anthony Ripoll, Bristol (GB)

(73) Assignee: AIRBUS OPERATIONS LIMITED, Bristol (GB)

( * ) Notice: Subject to any disclaimer, the term of this patent is extended or adjusted under 35 U.S.C. 154(b) by 78 days.

(21) Appl. No.: 17/491,197

(22) Filed: Sep. 30, 2021

(65) Prior Publication Data

US 2022/0152788 A1 May 19, 2022

(30) Foreign Application Priority Data

Nov. 18, 2020 (GB) ..... 2018145

(51) Int. Cl.
*B25B 11/02* (2006.01)
*B25B 21/00* (2006.01)
*B25B 23/14* (2006.01)

(52) U.S. Cl.
CPC ..... *B25B 11/02* (2013.01); *B25B 21/002* (2013.01); *B25B 21/007* (2013.01); *B25B 23/14* (2013.01)

(58) Field of Classification Search
CPC ..... B25B 21/002; B25B 21/007; B25B 11/02; B25B 23/14
See application file for complete search history.

(56) References Cited

U.S. PATENT DOCUMENTS 5,139,092 A * 8/1992 Boyle ..... B25B 5/061 173/32
5,490,439 A 2/1996 Matsumura et al.
5,855,052 A * 1/1999 Becker ..... F16B 5/0208 29/243.519
7,013,760 B1 * 3/2006 Kennison ..... B25B 23/0078 81/57.36

(Continued)

FOREIGN PATENT DOCUMENTS

GB 1 469 801 4/1977

OTHER PUBLICATIONS

United Kingdom Combined Search and Examination Report issued in Application No. GB2018145.9 dated May 18, 2021, 7 pages.

(Continued)

*Primary Examiner* — Andrew M Tecco
*Assistant Examiner* — Nicholas E Igbokwe
(74) *Attorney, Agent, or Firm* — Nixon & Vanderhye P.C.

(57) ABSTRACT

A method of installing a plurality of nut and bolt fasteners upon a structure is disclosed. The method includes placing a jig around the nut of a first fastener and the nut of a second fastener, securing the jig to the first fastener, and then using a power tool to tighten the nut of the second fastener to a target torque. The step of tightening the nut comprises engaging a socket portion of the power tool with the nut, securing the power tool to the jig such that a handle portion of the power tool is prevented from rotating about an axis of rotation of a socket portion of the power tool when the nut is being rotated by the socket portion. A jig, jig fasteners for securing a jig to a fastener, and a fastening head for a power tool are disclosed.

14 Claims, 6 Drawing Sheets

(56) References Cited

U.S. PATENT DOCUMENTS

| | | | | |
|---|---|---|---|---|
| 2012/0152067 | A1* | 6/2012 | Yoshimachi | B25B 13/06<br>81/57.36 |
| 2015/0209927 | A1* | 7/2015 | DeLand | B23Q 5/08<br>408/1 R |

OTHER PUBLICATIONS

Extended European Search Report for Application No. EP 21275138.2, eight pages, dated Mar. 1, 2022.

* cited by examiner

METHODS OF INSTALLING FASTENERS AND APPARATUS RELATING THERETO

CROSS RELATED APPLICATION

This application claims priority to United Kingdom Patent Application GB 2018145.9, filed Nov. 18, 2020, the entire contents of which is hereby incorporated by reference.

BACKGROUND OF THE INVENTION

The present disclosure relates to a method of installing fasteners in a structure. More particularly, but not exclusively, the invention relates to a method installing a plurality of nut and bolt fasteners upon a structure, wherein the fasteners are tightened to a target torque. The invention also concerns a load reaction jig, a jig fastener, and a fastening head for a power tool which are configured for use with the method.

In some structural applications, it is necessary to install nut and bolt fasteners with fastening torques of up to, and exceeding, 60 Newton-metres. When a hand-held power tool is used to install fasteners with such high torques, a large reaction force may be needed to hold the tool in place to prevent the tool rotating itself instead of the nut. If rotation of the tool is not constrained, then the rotating tool can injure the tool operator or lead to damage of the tool, associated tooling, and/or structure that is being constructed.

In order to address this issue, hand-held power tools can be fitted with a reaction arm. A reaction arm typically comprises an arm portion which is connected to the tool and a socket portion at the end of the arm portion which fits over the nut of a fastener. When the nut of a fastener is to be tightened using the tool, the socket portion of the reaction arm is placed over the nut of an adjacent fastener. The tool is therefore prevented from counter-rotating during fastener installation by reacting the counter-rotation force into the adjacent fastener via the reaction arm.

However, the reaction arm is cumbersome and awkward to install over the adjacent fastener. Furthermore, the reaction arm adds to the weight and the complexity of the bolting tooling, and the size of the reaction arm can also preclude the use of the tooling in restricted access applications.

The present invention seeks to mitigate the above-mentioned problems. Alternatively or additionally, the present invention seeks to provide an improved method of installing nut and bolt fasteners and apparatus relating thereto.

SUMMARY OF THE INVENTION

The present invention provides, according to a first aspect, a method of installing a plurality of nut and bolt fasteners upon a structure, wherein the bolt of a first fastener is located in a first hole of the structure and the bolt of a second fastener is located in a second hole of the structure and the nuts of the first and second fasteners are engaged with their respective bolts and have been tightened to an initial torque, the method comprising steps of placing a jig around the nut of the first fastener and the nut of the second fastener, securing the jig to the first fastener, using a power tool to tighten the nut of the second fastener to a target torque, the power tool comprising a handle portion and a socket portion. The step of tightening the nut comprises performing the nut tightening steps of: engaging the socket portion of the tool with the nut, securing the power tool to the jig such that the handle portion is prevented from rotating about an axis of rotation of the socket portion when the nut is being rotated by the socket portion, and operating the power tool to tighten the nut to the target torque.

The present invention provides a method of installing fasteners in which the counter-rotation force imparted by a power tool when a fastener is being tightened is reacted into a jig which is secured to another fastener which is located in a hole of the structure. As such, the load reacted into the jig is then reacted into the fastener to which the jig is secured. The method avoids the need for a bulky and complicated reaction arm to be installed on the power tool.

The invention arose through problems faced when installing nut and bolt fasteners in aerospace structures. For example, where fasteners are recessed in pockets and are difficult to fasten with a conventional tool with a reaction arm. However, it will be appreciated that the method is applicable in principle to any structure that requires a fastener installed to target torque which may result in the problems of counter-rotation of the power tool that have already been discussed.

The method may comprise a step of placing the bolt of the first fastener in the first hole of the structure and screwing the nut of the first fastener onto the bolt. The method may comprise the step of placing the bolt of the second fastener in the second hole of the structure and screwing the nut of the second fastener onto the bolt. The initial torque may be achieved by hand-tightening the nuts or by using, for example a run-down tool. The initial torque may be, for example, approximately 30 Newton-metres or less. However, in some embodiments of the invention the initial torque may be more than 30 Newton-metres.

Once the nut of the second fastener has been tightened, the method may comprise the step of using the power tool to tighten the nut of one or more other fasteners of the plurality of fasteners to the target torque. In embodiments of the invention where more than one nut is tightened during installation of the plurality of nut and bolt fasteners, it will be appreciated that the steps of nut-tightening may comprise engaging the socket portion of the tool with the nut to be tightened, securing the power tool to the jig such that the handle portion is prevented from rotating about an axis of rotation of the socket portion when the nut is being rotated by the socket portion, and operating the power tool to tighten the nut to the target torque.

After the step of tightening the nut of the second fastener, the method may comprise the steps of unsecuring the jig from the first fastener, securing the jig to the second fastener, and using the power tool to tighten the nut of the first fastener to the target torque. The jig may not be substantially moved between being unsecured from the first fastener and then secured to the second fastener. In other words, the jig may be in substantially the same position when secured to the second fastener as it was when secured to the first fastener. The nuts of the one or more other fasteners of the plurality may be tightened before the jig is unsecured from the fastener(s) that it is secured to.

The plurality of nut and bolt fasteners may comprise a third fastener. The bolt of the third fastener being located in a third hole of the structure and the nut of the third fastener being engaged with the bolt and having being tightened to an initial torque. During the step of placing the jig around the nut of the first fastener and the nut of the second fastener, the jig may also be placed around the nut of the third fastener. The nut of one of the fasteners may be tightened while the jig is secured to both of the other two fasteners.

The method may comprise the steps of unsecuring the jig from the third fastener, and using the power tool to tighten the nut of the third fastener. The jig may be secured to one or more of the other fasteners of the plurality when the nut of the third fastener is tightened. The jig may not be substantially moved between being unsecured from the third fastener and then secured to the one or more other fasteners. In other words, the jig may be in substantially the same position when the third fastener is being tightened to the target torque as it was when secured to the third fastener.

The plurality of nut and bolt fasteners may comprise a fourth fastener, the bolt of the fourth fastener being located in a fourth hole of the structure and the nut of the fourth fastener being engaged with the bolt and having being tightened to an initial torque. During the step of placing the jig around the nut of the first fastener, the nut of the second fastener, and the nut of the third fastener, the jig may also be placed around the nut of the fourth fastener. The nut of one of the fasteners may then be tightened while the jig is secured to each of the other three fasteners.

The method may comprise the step of unsecuring the jig from the fourth fastener and using the power tool to tighten the nut of the fourth fastener to the target torque. When the nut of a particular fastener is being tightened to the target torque by the power tool, the jig may be secured to one or more of the/any of the other fasteners of the plurality. For example, the jig may be secured to the first, second, and/or third fastener when the fourth fastener is being tightened. Similarly, the jig may be secured to the second, third, and/or fourth fastener when the first fastener is being tightened. The jig may not be substantially moved between being unsecured from the fourth fastener and then secured to another fasteners. In other words, the jig may be in substantially the same position when the fourth fastener is being tightened to the target torque as it was when secured to the fourth fastener.

Where multiple nuts need to be tightened, it will be appreciated that the method is particularly advantageous over the reaction arm of the prior art because the jig can be left in place while the tool is used to fasten the multiple nuts. The power tool is simply secured to the jig each time there is a nut that needs tightening.

In principle, the plurality of nut and bolt fasteners can comprise any number of number of fasteners, and the jig can be configured to be secured in place by securing the jig to any number of the fasteners. For example, the jig could be secured to 1, 2, 3, 4, 5, or more fasteners. However, the process of securing the jig takes time, so it may not be advantageous to secure the jig to a large amount of fasteners. It has been found that, for most applications, securing the jig to three fasteners is adequate.

The target torque may be above 30 Newton-metres. In some applications, the target torque is at least 50 Newton-metres. In other applications, the target torque may be at least 60 Newton-metres. In some applications, the target torque may be 100 Newton-metres or more. It will be appreciated that not all nuts will necessarily need to be tightened to the same target torque. For example, in some embodiments of the invention a plurality of nuts may each be tightened to a different target torque.

The jig may be secured to a nut and bolt fastener by a jig fastener that is configured to engage with the jig, and with the nut and/or bolt of the nut and bolt fastener.

The power tool may comprise formations (e.g. male formations) configured to engage with corresponding formations (e.g. female formations) on the jig so that the power tool becomes secured to the jig. The power tool may comprise, for example, key portions configured to engage with a corresponding bayonet fitting on the jig, or vice versa. Accordingly, the step of securing the power tool to the jig may comprise engaging the formations of the power tool with the corresponding formations on the jig.

The step of placing the jig around the nut of the first fastener and the nut of the second fastener may comprise positioning a projecting feature of the structure in a cut-out of the jig. The projecting feature may be, for example, a flange or other structural feature of an aircraft. A first portion of the jig may therefore be positioned on a first side of the projecting feature and a second portion of the jig may be positioned on a second, opposite side of the projecting feature. Therefore, while the jig is secured to one or more fasteners, it may be possible to tighten the nuts of fasteners positioned on either side of the projecting feature.

According to a second aspect of the invention, there is provided a jig for use with the method of the first aspect of the invention. The jig comprises a plate portion formed with a plurality of holes therein, wherein each hole is configured to receive the bolt of a fastener, and adjacent each of the holes the plate comprises formations configured to engage with corresponding formations on a fastening head of a power tool in order to secure the fastening head of the power tool to the jig. The holes in the jig may also be configured to receive a jig fastener and/or a fastening head of a power tool. The diameter of the holes in the jig may be proportional to the size of the fastener. For example, where the bolt of a fastener is 16 millimetres in diameter, the hole in the jig may be approximately 45 millimetres in diameter. The holes may be between 20 millimetres and 150 millimetres in diameter.

The formations adjacent each hole may provide a bayonet fitting for engagement with a fastening head of a power tool. In that case, the formations may comprise notches that extend in a radial direction from the circumference of each of the holes. On a first face of the plate there may be a recess adjacent each of the notches. The notches and recesses may provide a bayonet fitting at each hole. The jig may therefore be configured so that the fastening head of the power tool is inserted into the holes from a second, opposite face of the plate. Alternatively, the formations may instead be key portions configured to engage with a bayonet fitting located on the fastening head of the power tool.

The plate may be formed with a cut-out, and one or more of the holes of the plurality may be positioned on a first side of the cut-out and one or more of the holes of the plurality may be positioned on a second, opposite side of the cut-out. There may be a plurality of cut-outs. The cut-outs may be configured to receive projecting portions of a structure when the jig is in use.

According to a third aspect of the invention, there is provided a jig fastener for use with the method of the first aspect of the invention and/or the jig of the second aspect of the invention. The jig fastener comprises a body portion configured to engage with a jig and a fastener engaging portion configured to engage with the nut and/or bolt of a fastener, the jig fastener thereby being configured to secure the jig to the fastener.

The body portion may be configured to be received within a hole of a jig. The body may comprise a socket portion for engagement with the nut of a fastener. The jig fastener may comprise a clamping mechanism for clamping the body to the nut of the fastener to secure the jig upon the fastener. The body may comprise a split along the length of the body and the clamping mechanism may move opposing faces of the split closer together to effect clamping of the nut. The clamping mechanism may comprise a lever-operated cam.

The fastener engaging portion may comprises a thread-engaging member for screwing on to the bolt of the fastener. The thread engaging member may be configured to clamp the body portion against a structure in use. The body portion may comprise a lip configured to engage with a jig in use to secure the jig to the fastener.

The body may comprise formations configured to engage with corresponding formations on a jig to secure the jig fastener to the jig. The formations may be key portions which project from an outer surface of the body and are configured to engage with a bayonet fitting of the jig. Alternatively, the jig fastener may itself be formed with a bayonet fitting that is configured to engage with key portions formed on the jig.

According to a fourth aspect of the invention, there is provided a fastening head for a power tool configured for use with the method of the first aspect of the invention and/or the jig of the second aspect of the invention. The fastening head comprises a rotatable socket portion for engagement with a nut, and a body portion comprising formations for engagement with corresponding formations on a fastening jig, the formations being arranged circumferentially around the socket portion.

The body portion may be configured to engage with, and be secured to, the fastening jig so that when the rotatable socket portion is used to tighten the nut of a fastener to a target torque, the counter-rotation force imparted on the fastening head is reacted onto the fastening jig. The body portion of the fastening head therefore may remain stationary with respect to the fastening jig, and cannot itself rotate, when the nut is being tightened to the target torque.

It will be understood that the fastening head may be configured to be mounted to a fastening tool which is designed to be fitted different fastening heads. Alternatively, the fastening head may form an integral part of a fastening tool and therefore may not be configured to be removable from the fastening tool during routine use.

The formations may be, for example, a bayonet fitting (e.g. provided by recesses, slots, etc.) configured to engage with corresponding key portions located on the fastening jig. Alternatively, the formations may comprise key portions that project in a radial direction with respect to the socket portion. There may be two or more key portions. The key portions may be configured to engage in a bayonet fitting on the fastening jig.

According to a fifth aspect of the invention, there is provided a power tool comprising the fastening head of the fourth aspect of the invention.

According to a further aspect of the invention, there is provided a kit of parts for fastening a plurality of nut and bolt fasteners to a structure to be fastened, the kit of parts comprising two or more of: a jig according to the second aspect of the invention, a jig fastener according to the third aspect of the invention, a fastening head according to the fourth aspect of the invention, a power tool according to the fifth aspect of the invention, and/or a plurality of nut and bolt fasteners.

It will of course be appreciated that features described in relation to one aspect of the present invention may be incorporated into other aspects of the present invention. For example, the method of the first aspect of the invention may incorporate any of the features described with reference to the apparatus of the second to fifth aspects of the invention and vice versa.

DESCRIPTION OF THE DRAWINGS

Embodiments of the present invention will now be described by way of example only with reference to the accompanying schematic drawings of which.

DETAILED DESCRIPTION

Figure 1:
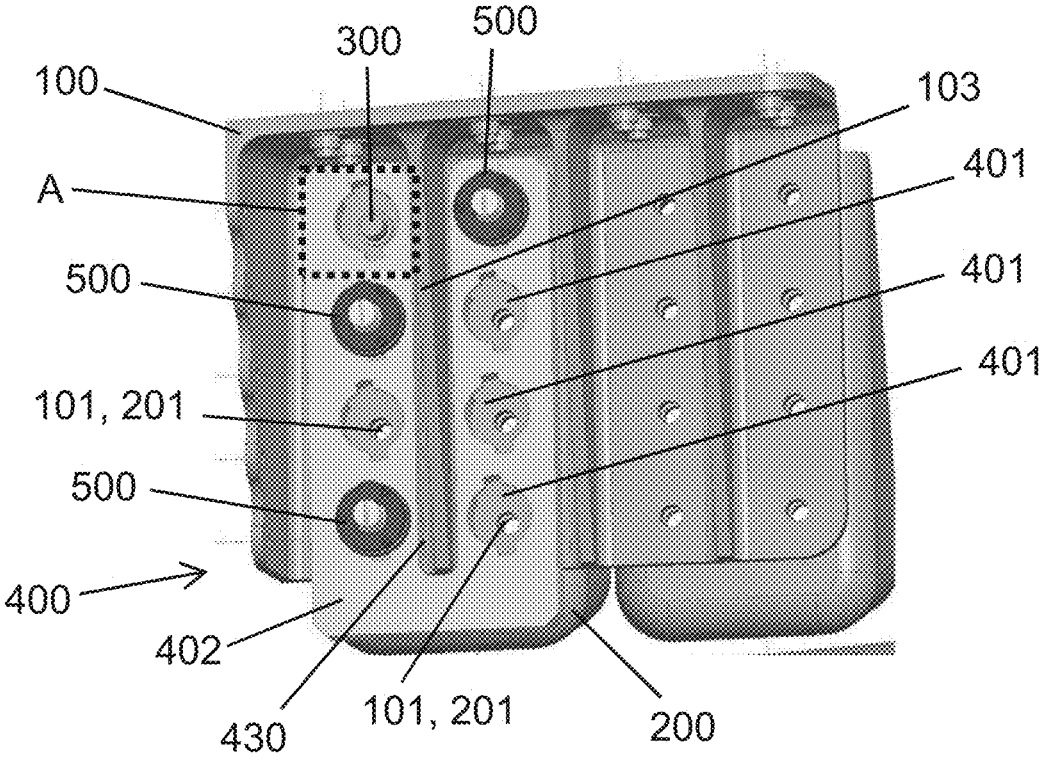
FIG. 1 shows a load reaction jig held in place upon an aircraft structure by three nut covers.

FIG. 1 shows a first aircraft structure 100 and a second aircraft structure 200 which have been prepared for fastening together according to an embodiment of the invention. The first structure 100 and second structure 200 are configured to be fastened together by a plurality of nut and bolt fasteners 300 of the type which are well known in the art. As can be seen in FIG. 1, the first aircraft structure 100 and a second aircraft structure 200 are both formed with a plurality of holes 101, 201 therein and have been placed together such that their respective holes 101, 201 are aligned. FIG. 1 also shows a load reaction jig 400 which has been placed against the first structure 100 such that it is aligned with the holes 101, 201 of the structures 100, 200. The load reaction jig 400 is held in place upon the first structure 100 by three nut covers 500.

Figure 2:
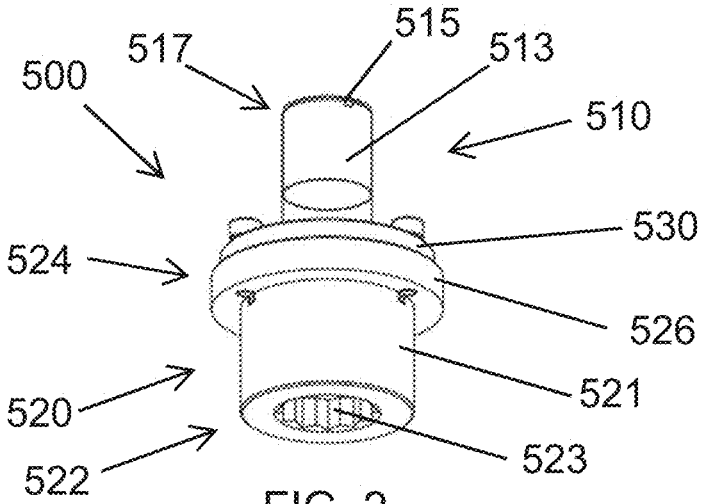
FIG. 2 shows an embodiment of a nut cover in isolation.

A single nut cover or jig fastener 500 is shown in isolation in FIG. 2. The nut cover 500 comprises a bolt-engaging member 510 contained within a housing 520. The bolt-engaging member 510 is formed by an internally-threaded head 511, which is visible in the cross-sectional view of FIG. 3, and a cylindrical shaft 513 which projects from the head 511. The internally-threaded head 511 has a first outer diameter, and the cylindrical shaft 513 has a second, smaller diameter. A slot 515 is formed in the distal end 517 of the shaft 513 so that the bolt-engaging member 510 can be rotated using a flat-head screwdriver, as described below.

The housing 520 is formed by a substantially cylindrical hollow body 521 which has an internal diameter that is slightly larger than the outer diameter of the head 511 of the bolt-engaging member 510. The bolt-engaging member 510 is contained inside the housing 520 in co-axial alignment with the body 521. As shown in the cross-sectional view of FIG. 3, the housing 520 is formed with a reduced diameter at a first, fastener-receiving end 522 of the housing that provides a nut-receiving socket 523. At a second, opposite, end 524 of the housing 520, the housing 520 is formed with a lip portion 526 that projects outwardly from the body 521 in a radial direction. An annular plate 530 formed with a hole having a diameter that is slightly larger than the diameter of the shaft 513 is bolted to the lip portion at the second end 524 of the housing 520. The head 511 of the bolt-engaging member 510 is thereby retained within the housing 520 by the reduced-diameter of the socket 523 at the first, fastener-receiving end 522 of the housing 520 and by the annular plate 530 at the second, opposite, end of the housing 520.

Figure 4:
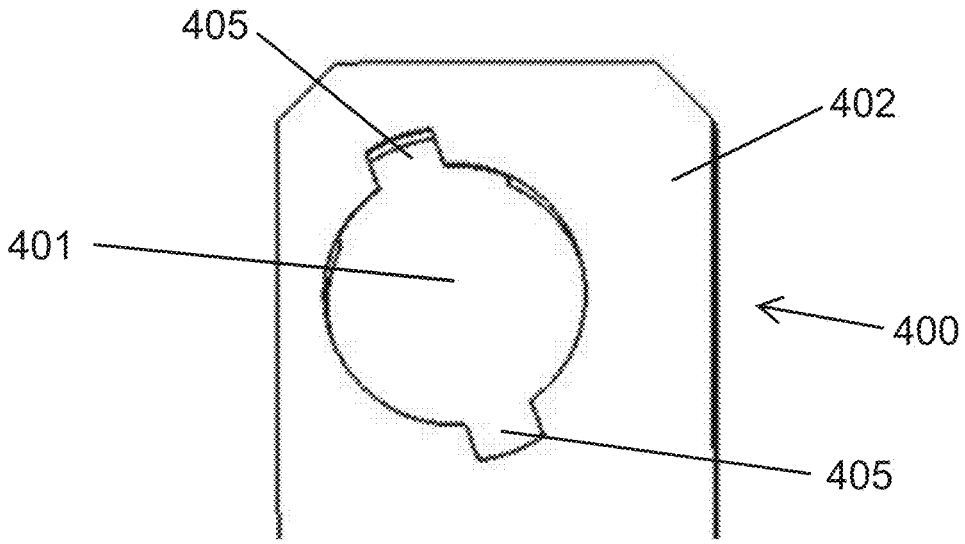
FIG. 4 shows the portion of the jig labelled "A" in FIG. 1.
Figure 6A:
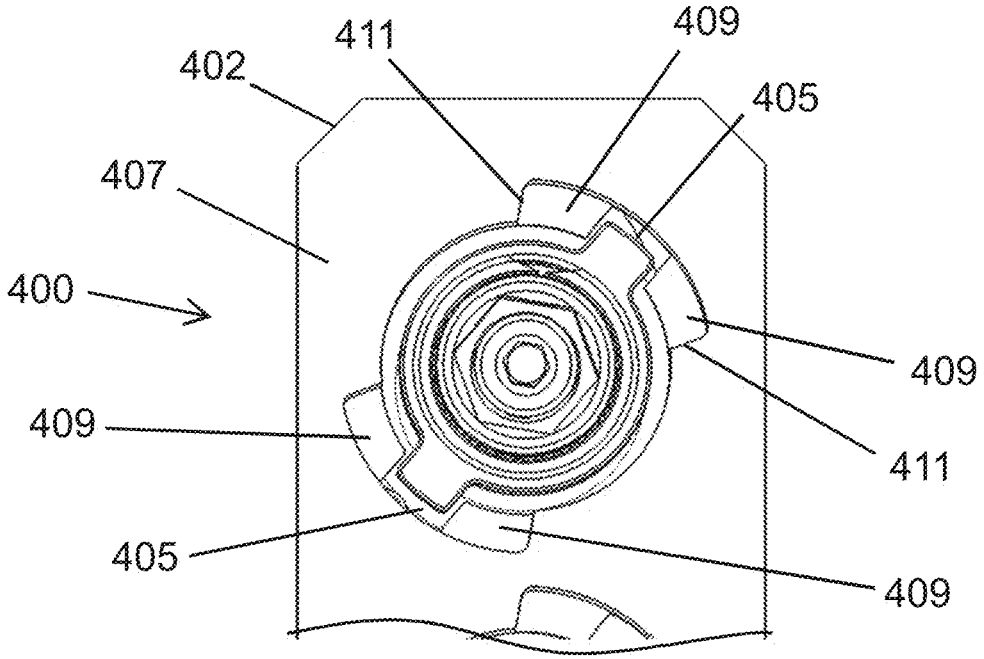
FIG. 6A is a rear view of the portion of the jig shown in FIG. 4 with the fastening head of the tool positioned in a hole of the jig in an unlocked position.
Figure 6B:
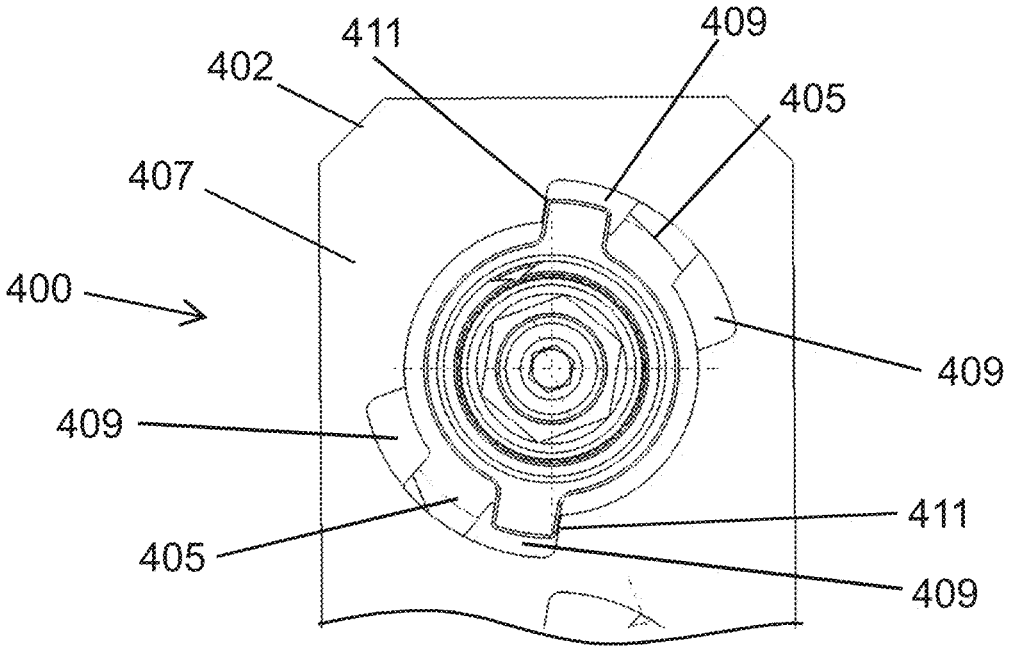
FIG. 6B corresponds to FIG. 6A but with the fastening head of the tool positioned in a locked position.

The section of the load the jig 400 labelled A in FIG. 1 is shown in more detail from a front view in FIG. 4 and from a rear view in FIG. 6A and FIG. 6B. The load reaction jig 400 comprises a plate 402 formed with a plurality of holes 401 therein. The holes 401 are positioned so that they align with the holes 101, 201, in the aircraft structures 100, 200 when the load reaction jig 400 is in place upon the first structure 100, as shown in FIG. 1. The diameter of each hole 401 is slightly larger than the outer diameter of the body 521 of the nut cover housing 520, and is formed with two notches 405 that extend in a radial direction on opposite sides of the hole 401. On the rear-face 407 of the plate 402, recesses 409 are formed on either side of the notches 405. The plate 402 is also formed with an elongate cut-out 430 which results in the plate 402 have a "U" shape. The cut-out 430 is configured to receive a protruding feature 103 of the first structure 100 when the jig 400 is in place upon the first aircraft structure 100, as shown in FIG. 1.

Figure 5:
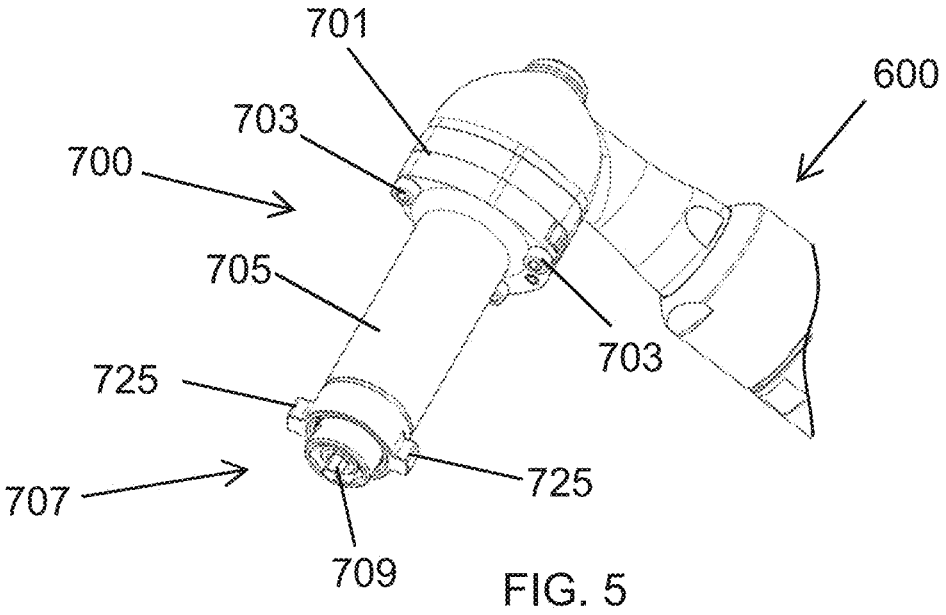
FIG. 5 shows a fastening tool fitted with a fastening head.

The jig 400 is configured for use with a fastening tool 600 which has been fitted with a specially adapted fastening head 700 that is shown in FIG. 5. The fastening head 700 comprises a mounting portion 701 which is configured so that the head 700 can be mounted upon the fastening tool 600, which is an off-the-shelf model. In this case the mounting portion 701 is bolted to the tool 600 via bolts 703. The fastening head 700 comprises a cylindrical arm portion 705 having an outer diameter that is approximately equal to the outer diameter of the body 521 of the nut cover housing 520, so that the arm portion 705 can be inserted into a hole 401 of the jig 400. The arm portion 705 projects from the mounting portion 701 and, at the distal end 707, the arm portion 705 comprises two key portions 725 which project from the arm portion 705. The key portions 725 are positioned on radially opposite sides of the arm portion 705 and are configured to be received in the notches 405 of the jig 400, as described in more detail below. Also at the distal end 707 the arm 705, the fastening head comprises a socket portion 709. The socket portion 709 is mechanically coupled to the tool 600 and is configured to engage with the nuts 301 of the fasteners 300 so that the nuts 301 can be tightened using the tool 600 to drive rotation of the socket portion 709.

Figure 7:
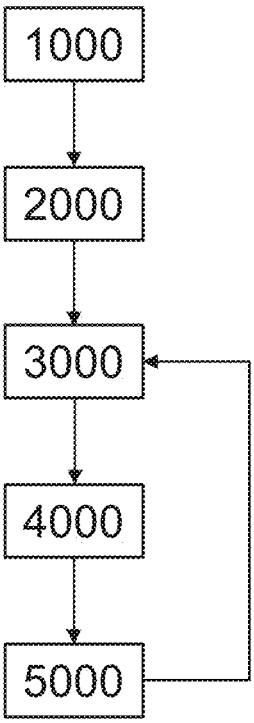
FIG. 7 shows the steps of fastening together two aircraft structures in accordance with an embodiment of the invention.

Use of the jig 400, nut-covers 500, and fastening head 700 in a method of fastening together two aircraft structures in accordance with an embodiment of the invention will now be described with reference to FIG. 7. In step 1000, the fasteners 300 are loosely installed in the holes 101, 201 of the of the aircraft structures 100, 200 and tightened to a nominal torque. The fasteners 300 may be tightened by hand at this stage or, for example, by using a run-down tool to tighten them to around 30 Nm. In step 2000, the jig 400 is moved into position upon the first structure, as shown in FIG. 1, with the holes 101, 201 of the aircraft structures 100, 200 aligned with the holes 401 of the jig 400, and with the protruding portion 103 of the first aircraft structure 100 received in the cut-out 430 of the jig 400.

The jig 400 is then clamped in place in step 3000 using the nut covers 500. To engage a nut cover 500 with the jig 400, first the housing 520 of the nut cover is moved into the hole 401 to engage the socket portion 523 of the housing 520 with the nut 301 of the fastener 300 that is positioned in the hole 101, 201. In this configuration, the housing 520 of the nut cover 500 is prevented from rotating by the engagement of the socket portion 523 with the nut 301.

Figure 3:
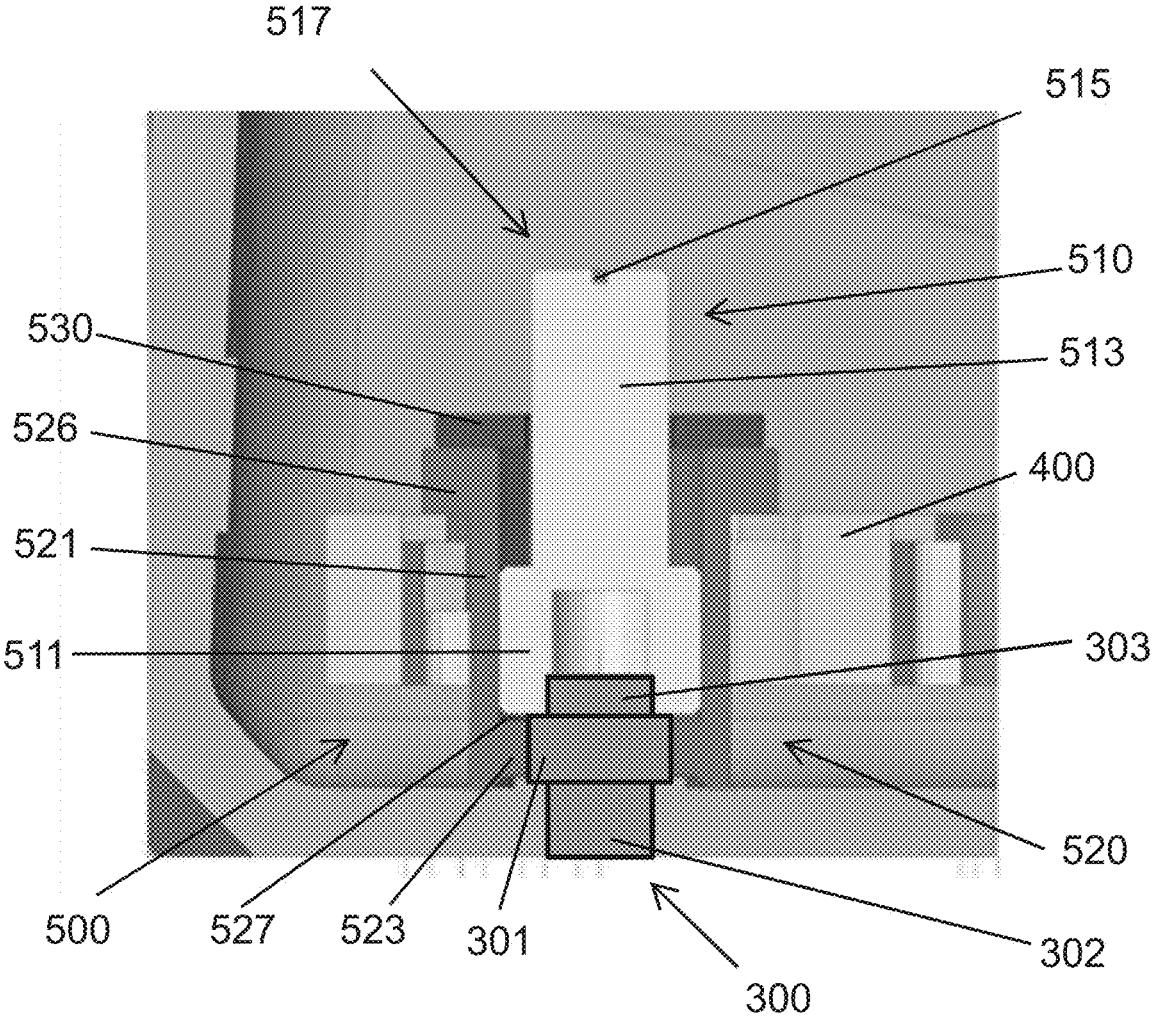
FIG. 3 is a cross-sectional view of FIG. 1, showing a nut cover engaged with a fastener to hold the jig in place upon the aircraft structure.

As can be seen in FIG. 3, a distal portion 303 of the bolt 302 projects past the nut 301 towards the nut cover 500. With the housing 520 of the nut cover 500 engaged with the nut 301, the head 511 of the bolt-engaging member 510 is then moved into engagement with the distal portion 303 of the bolt 302 and screwed onto the distal portion 303 of the bolt 302 using a flat-head screwdriver in the slot 515. As the bolt-engaging member 510 is screwed onto the bolt 302, the head 511 abuts the rear surface 527 of the socket portion 523 and pushes the housing 520 into abutment with the first structure 100. The housing 520 is then clamped to the first structure by tightening the bolt-engaging member 510. As can be best seen in FIG. 3, with the nut cover 500 secured to the fastener 300, the jig 400 is prevented from being moved away from the first structure 100 by the lip 526 of the nut cover housing 520, which extends to a diameter that is greater than the hole 401 of the jig 400. FIG. 1 shows the jig 400 being held in place by three nut covers 500. However, any number of nut covers 500 can be used. In principle, only one nut cover 500 could be used.

With the jig 400 clamped in place, the fastening tool 600 fitted with the fastening head 700 is then used in step 4000 to tighten the nuts 301 of the fasteners 300 which are not covered by nut covers 500. In order to tighten a nut 301, the key portions 725 of the fastening head 700 are inserted into the notches 405 of the hole 401 in the jig 400 that surrounds the nut 301, as shown in FIG. 6A. The tool 600 is then moved to a locked position, shown in FIG. 6B, by rotating the tool 600 to move the key portions 725 of the fastening head 700 into the recesses 409 formed in the rear face 407 of the jig. The notches 405 and recesses 409 of the jig 400 thereby provide a "bayonet" or "twist-to-lock" mount for the fastening head 700.

The purpose of the jig 400 is to prevent the fastening tool 600 counter rotating when tightening the nuts 301 to a high torque, which may cause injury to the operator or damage the tooling and/or structure. The jig 400 does this by reacting the counter-rotation forces imparted by the fastening tool 600 when the nut 301 is being tightened by the tool 600. Where the nut 301 is tightened by rotating it clockwise from the perspective of the operator of the tool 600, as is the case here, there is a risk that the tool 600 itself will rotate clockwise if it is not held firmly. Therefore, the tool 600 must be moved to a locked position by rotating the key portions 725 of the fastening head 700 clockwise into the recesses 409 of the jig (FIG. 6B is a view of the rear face 407 of the jig, so the key portions appear to have moved anticlockwise to the locked position from FIG. 6A). With the tool in the locked position, clockwise rotation of the tool 600 during the fastening process is prevented by the key portions 725 of the fastening head rotating clockwise into abutment with the walls 411 of the recesses 409.

When the nut 301 is being unfastened, or where a nut 301 is tightened by rotating it anticlockwise from the perspective of the operator of the tool, the key portions 725 of the fastening head 700 must be rotated anticlockwise into the recesses 409 of the jig so anticlockwise rotation of the tool 600 during the fastening process is prevented by the key portions 725 of the fastening head rotating anticlockwise into abutment with the walls 411 of the recesses 409. With the fastening head 700 correctly located in the jig 400, the tool 600 can be operated to tighten the nut 301 to the desired torque.

The operator tightens all accessible fasteners 300 using the tool 600 and fastening head 700 in this way. Once all accessible fasteners 300 are tightened, the operator then removes the nut covers 500 from the loosely tightened fasteners 300 in step 5000. Steps 3000 and 4000 are then repeated by repositioning the nut covers 500 onto the fully torqued fasteners 300 and by tightening the now accessible loosely tightened fasteners 300 using the tool 600 and fastening head 700 engaged with the jig 400 as described.

Figure 8:
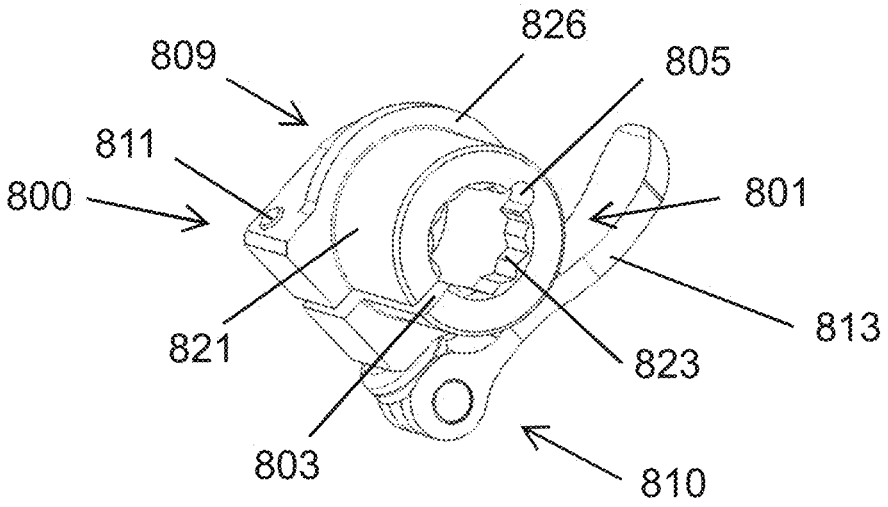
FIG. 8 shows a second embodiment of a nut cover in isolation.

A second embodiment of a nut cover 800 is shown in isolation in FIG. 8. Like the first embodiment of the nut cover 500, shown in FIG. 2 and FIG. 3, the nut cover 800 has a hollow cylindrical body 821 with a socket portion 823 formed in a first end 801 of the body 821 and a lip 826 formed at a second end 809 of the body 821. The diameter of the body 821 of the nut cover 800 is slightly smaller than the diameter of the holes 401' in the jig, so that the body can be inserted into a hole 401' in the jig. A split 803 is formed in the body 821, along the length of the body 821, and a groove 805 is formed along the inner surface 807 of the body 821, diametrically opposite the split 803. At the second end 809 of the body 821, the nut cover comprises a lever-operated cam system 810 of the type commonly seen, for example, on bicycles for clamping the seat post. The system 810 comprises a skewer 811 which bridges the split and is connected to a cam lever 813. The lever-operated cam system 810 is arranged such that operation of the cam lever causes the opposing faces of the split 803 to be moved closer together.

Figure 9:
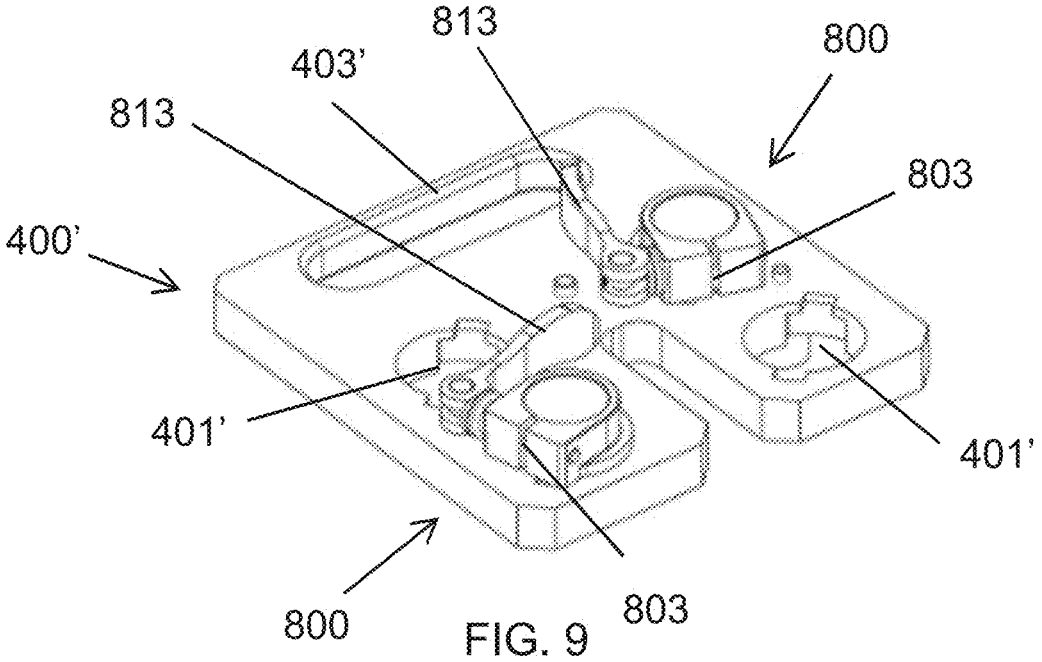
FIG. 9 shows the second embodiment of a nut cover in use with a second embodiment of a load reaction jig.

FIG. 9 shows the nut cover 800 in use with a second embodiment of a jig 400'. The jig 400' is formed with fewer holes 401' than the first embodiment of the jig 400 and also comprises a handle 403'. The nut covers 800 function by moving the body 821 into a hole 401' in the jig 400' and engaging the socket portion 823 of the nut cover 800 with a nut 301. The lever-operated cam system 810 is then operated to clamp the body 821 upon the nut 301. This jig is then held in place between the circumferential lip 826 of the nut cover 800 and the first aircraft structure 100.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may not be desirable, and may therefore be absent, in other embodiments.

The invention claimed is:

1. A method of installing a plurality of nut and bolt fasteners upon a structure, wherein the bolt of a first fastener is located in a first hole of the structure and a bolt of a second fastener is located in a second hole of the structure and the nuts of the first and second fasteners are engaged with their respective bolts and have been tightened to an initial torque, the method comprising steps of:

placing a jig around the nut of the first fastener and the nut of the second fastener, using a jig fastener to secure the jig to the first fastener, wherein the jig fastener engages with the jig and with the nut of the first fastener, wherein the jig fastener comprises a fastener engaging portion having a clamping mechanism for clamping a body portion of the jig fastener to the nut of the fastener to secure the jig upon the fastener, using a power tool to tighten the nut of the second fastener to a target torque, the power tool comprising a handle portion and a socket portion, wherein the step of tightening the nut comprises performing the following nut tightening steps:

engaging the socket portion of the tool with the nut, securing the power tool to the jig such that the handle portion is prevented from rotating about an axis of rotation of the socket portion when the nut is being rotated by the socket portion, and operating the power tool to tighten the nut to the target torque.

2. The method of claim 1, wherein, once the nut of the second fastener has been tightened, the method comprises the step of using the power tool to tighten the nut of one or more other fasteners of the plurality of fasteners to the target torque, the nut(s) being tightened by following the nut tightening steps.

3. The method of claim 1, wherein, after the step of tightening the nut of the second fastener, the method comprises the steps of:

unsecuring the jig from the first fastener securing the jig to the second fastener, and using the power tool to tighten the nut of the first fastener to the target torque by following the nut tightening steps.

4. The method of claim 1, wherein the plurality of nut and bolt fasteners comprises a third fastener, the bolt of the third fastener being located in a third hole of the structure and the nut of the third fastener being engaged with the bolt and having being tightened to an initial torque, and wherein, during the step of placing the jig around the nut of the first fastener and the nut of the second fastener, the jig is also placed around the nut of a third fastener, and wherein the nut of one of the fasteners is tightened while the jig is secured to both of the other two fasteners.

5. The method of claim 4, comprising the step of:

unsecuring the jig from the third fastener, using the power tool to tighten the nut of the third fastener to the target torque by following the nut tightening steps.

6. The method of claim 4, wherein the plurality of nut and bolt fasteners comprises a fourth fastener, the bolt of the fourth fastener being located in a fourth hole of the structure and the nut of the fourth fastener being engaged with the bolt and having being tightened to an initial torque, and wherein, during the step of placing the jig around the nut of the first fastener, the nut of the second fastener, and the nut of the third fastener, the jig is also placed around the nut of the fourth fastener, and wherein the nut of one of the fasteners is tightened while the jig is secured to each of the other three fasteners.

7. The method of claim 6, comprising the step of:

unsecuring the jig from the fourth fastener, using the power tool to tighten the nut of the fourth fastener to the target torque by following the nut tightening steps.

8. The method of claim 1, wherein the target torque is at least 50 Newton metres.

9. The method of claim 1, wherein the power tool comprises formations configured to engage with corresponding formations on the jig, and the step of securing the power tool to the jig comprises engaging the formations of the power tool with the corresponding formations on the jig.

10. The method of claim 1, wherein the step of placing the jig around the nut of the first fastener and the nut of the second fastener comprises positioning a projecting feature of the structure in a cut-out of the jig.

11. A jig fastener for use as the jig fastener of claim 1, wherein the jig fastener comprises a body portion configured to engage with a jig and a fastener engaging portion, wherein the body portion comprises a socket portion for engagement with a nut of a fastener and the fastener engaging portion comprises a clamping mechanism for clamping the body portion to the nut of the fastener to secure the jig upon the fastener.

12. The jig fastener of claim 11, wherein the body portion comprises a lip configured to engage with a jig in use to secure the jig to the fastener.

13. A method of installing a plurality of nut and bolt fasteners upon a structure, wherein the bolt of a first fastener is located in a first hole of the structure and a bolt of a second fastener is located in a second hole of the structure and the nuts of the first and second fasteners are engaged with their respective bolts and have been tightened to an initial torque, the method comprising steps of:

placing a jig around the nut of the first fastener and the nut of the second fastener, using a jig fastener to secure the jig to the first fastener, wherein the jig fastener comprises a body having a socket for engagement with a nut of a fastener and a fastener engaging portion having a thread-engaging member for screwing on to a bolt of the fastener to secure the jig upon the fastener, using a power tool to tighten the nut of the second fastener to a target torque, the power tool comprising a handle portion and a socket portion, wherein the step of tightening the nut comprises performing the following nut tightening steps:

engaging the socket portion of the tool with the nut, securing the power tool to the jig such that the handle portion is prevented from rotating about an axis of rotation of the socket portion when the nut is being rotated by the socket portion, and operating the power tool to tighten the nut to the target torque.

14. A jig fastener for use as the jig fastener of claim 13, wherein the jig fastener comprises a body portion configured to engage with a jig and a fastener engaging portion, wherein the body portion comprises a socket portion for engagement with a nut of the fastener and the fastener engaging portion comprises a thread-engaging member for screwing on to a bolt of the fastener to secure the jig upon the fastener.

* * * * *